US007819162B2

(12) United States Patent
Pool

(10) Patent No.: US 7,819,162 B2
(45) Date of Patent: Oct. 26, 2010

(54) MASKING MACHINES

(76) Inventor: Dan B. Pool, 12772 E. Turquoise Av., Scottsdale, AZ (US) 85259

( * ) Notice: Subject to any disclaimer, the term of this patent is extended or adjusted under 35 U.S.C. 154(b) by 891 days.

(21) Appl. No.: 11/683,964

(22) Filed: Mar. 8, 2007

(65) Prior Publication Data

US 2007/0209762 A1 Sep. 13, 2007

Related U.S. Application Data

(60) Provisional application No. 60/779,923, filed on Mar. 8, 2006.

(51) Int. Cl.
*B44C 7/00* (2006.01)
*B32B 37/00* (2006.01)

(52) U.S. Cl. ..... 156/527; 156/554; 156/577; 156/579

(58) Field of Classification Search ..... 156/577, 156/579, 527, 554; 248/37.6
See application file for complete search history.

(56) References Cited

U.S. PATENT DOCUMENTS 3,950,214 A 4/1976 Pool et al.
4,096,021 A 6/1978 Pool et al.
RE30,787 E * 11/1981 Pool et al. ..... 156/527
4,379,019 A 4/1983 Pool
4,667,891 A 5/1987 Pool
4,783,016 A 11/1988 Pool
4,913,767 A 4/1990 Longworth
4,989,769 A * 2/1991 Longworth et al. ..... 225/20
5,667,626 A 9/1997 Cayford et al.
5,676,677 A * 10/1997 Landis et al. ..... 606/167
5,683,542 A * 11/1997 Poole ..... 156/494
6,497,263 B1 * 12/2002 Pitzen ..... 156/527
2004/0244917 A1 * 12/2004 Wojtkun et al. ..... 156/577

* cited by examiner

*Primary Examiner*—George R Koch, III
(74) *Attorney, Agent, or Firm*—Parsons & Goltry; Robert A. Parsons; Michael W. Goltry

(57) ABSTRACT

A hand held masking machine is described having one or more of the following features: a structurally designed metal frame, a directional handle with thumb grip, a cutting blade with a slotted adjusting means, a sheet reel including a wire spring with four pressure points for various core sizes, and a tape reel with a tapered face and flexible ribs that holds a variety of tape widths.

12 Claims, 6 Drawing Sheets

MASKING MACHINES

FIELD OF THE INVENTION

The present invention relates to the field of masking machines. Particularly, it relates to masking machines such as those used for applying tape and other surface preparatory materials. More particularly, the invention relates to improvements to enhance the utility of a masking machine.

BACKGROUND

Devices for the application of tape and other surface preparatory materials, such as paper, plastic sheets, etc., are well known and are generally referred to as masking machines. Generally, masking machines are employed for protecting a designating portion of a surface from a finish or treatment applied to an adjacent portion of the surface in preparation for painting, trimming and other finishing techniques; for example, in general painting and decorative trimming of vehicle bodies, walls of buildings and other large and small items.

There is a need to create masking machines with improved mechanical properties and enhanced ergonomics for the user. For example, there is a need to provide for a masking machine one or more of the following: an ergonomic thumb grip, a directional handle for improved dispensing control and improved cutting of sheet and tape, a blade slot fastened with screw or thumbscrew to masking machine to allow smooth adjustment and quick changing of sizes of the cutting blade, an improved sheet reel spring that holds a masking roll evenly onto a sheet reel, and a tapered spring that allows the masking roll to slip onto a tape reel.

Information relevant to hand held devices can be found in U.S. Pat. No. 3,950,214 (Pool et al.), U.S. Pat. No. 4,096,021 (Pool et al.), U.S. Pat. No. 4,379,019 (Pool), U.S. Pat. No. 4,667,891 (Pool), U.S. Pat. No. 4,783,016 (Pool), U.S. Pat. No. 4,913,767 (Longworth), U.S. Pat. No. 5,667,636 (Cayford et al.); each of the foregoing United States Patent is hereby incorporated herein by reference. Each one of these referenced items, however, suffers from one or more of the needs cited above.

For example, one disadvantage is that they do not use an ergonomic thumbgrip.

For example, another disadvantage is that they do not have a blade slot fastened with a screw or thumbscrew to the masking machine to allow smooth adjustment and quick changing of sizes of the cutting blade.

SUMMARY

It is an object of the present invention in one embodiment to provide a hand held masking machine for dispensing sheet and tape to a surface comprising: a frame having an outer side and an inner side, and a forward portion and a rearward portion; an offset section to the frame displaced in the direction of the outer side of the frame; a tape roll holder mounted on the outer side of the rearward portion of the frame for rotation about a first axis, the tape roll holder adapted to have a roll of tape mounted thereon; a reel mounted on the inner side of the offset section of the frame for rotation about a second axis, the reel adapted to have a roll of sheet having a hollow cylindrical bore mounted thereon for rotation about the second axis; a offset bracket mounted on the frame between the forward and reward positions and extending in a direction substantially parallel to the second axis and away from the inner side of the frame; a handle including a thumbgrip secured to the offset bracket and depending from the handle bracket so that the hand of the user of the masking machine is spaced from the inner side of the frame; and a guide bar having a slotted adjusting means mounted on the front portion of the frame. Preferably, the reel further comprises two retention members coupled thereto, each retention member having two outwardly projecting contact portions, and more preferably the reel further comprises at least two fluted outer surfaces. Also preferably, the tape roll holder has an inner end closer to the frame and an outer end and further comprises three radially extending circumferentially spaced hub portions having longitudinally extending ribs that define a peripheral surface that is tapered from the inner end to the outer end and adapted to the bore of the core of the tape roll. In a another preferred embodiment, the guide bar having the slotted adjusting means mounted on the forward portion of the frame comprises a mounting bracket mounted on the forward portion of the frame and extending inwardly from the frame in a direction substantially parallel to the second axis and a nose plate having a locking mechanism coupled to the mounting bracket and wherein the guide bar comprises an adjustable blade slot; wherein the guide bar is coupled to the nose plate using the locking mechanism, and more preferably the locking mechanism is selected from the group consisting of set screw, thumb screw or screw lock. In yet another preferred embodiment, the reel further comprises two retention members coupled thereto, each retention member having two outwardly projecting contact portions, and more preferably the reel further comprises at least two fluted outer surfaces. In another preferred embodiment, the invention further comprising a tensioning means coupled to the inner side of the frame wherein the tensioning means functions to contact the tape to the edge of the sheet, and more preferably, the tensioning means comprises an arm having a tensioning fixed end, a tensioning free end, a secured projection and a torsion spring wherein the torsioning fixed end is movably coupled to the inner portion of the frame such that the secured projection is urged toward the reel.

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. §112, paragraph 6 to define the invention. To the contrary, if the provisions of 35 U.S.C. §112, paragraph 6, are sought to be invoked to define the invention(s), the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. §112, paragraph 6. Moreover, even if the provisions of 35 U.S.C. §112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

DESCRIPTION OF PREFERRED EMBODIMENTS

Figure 1:
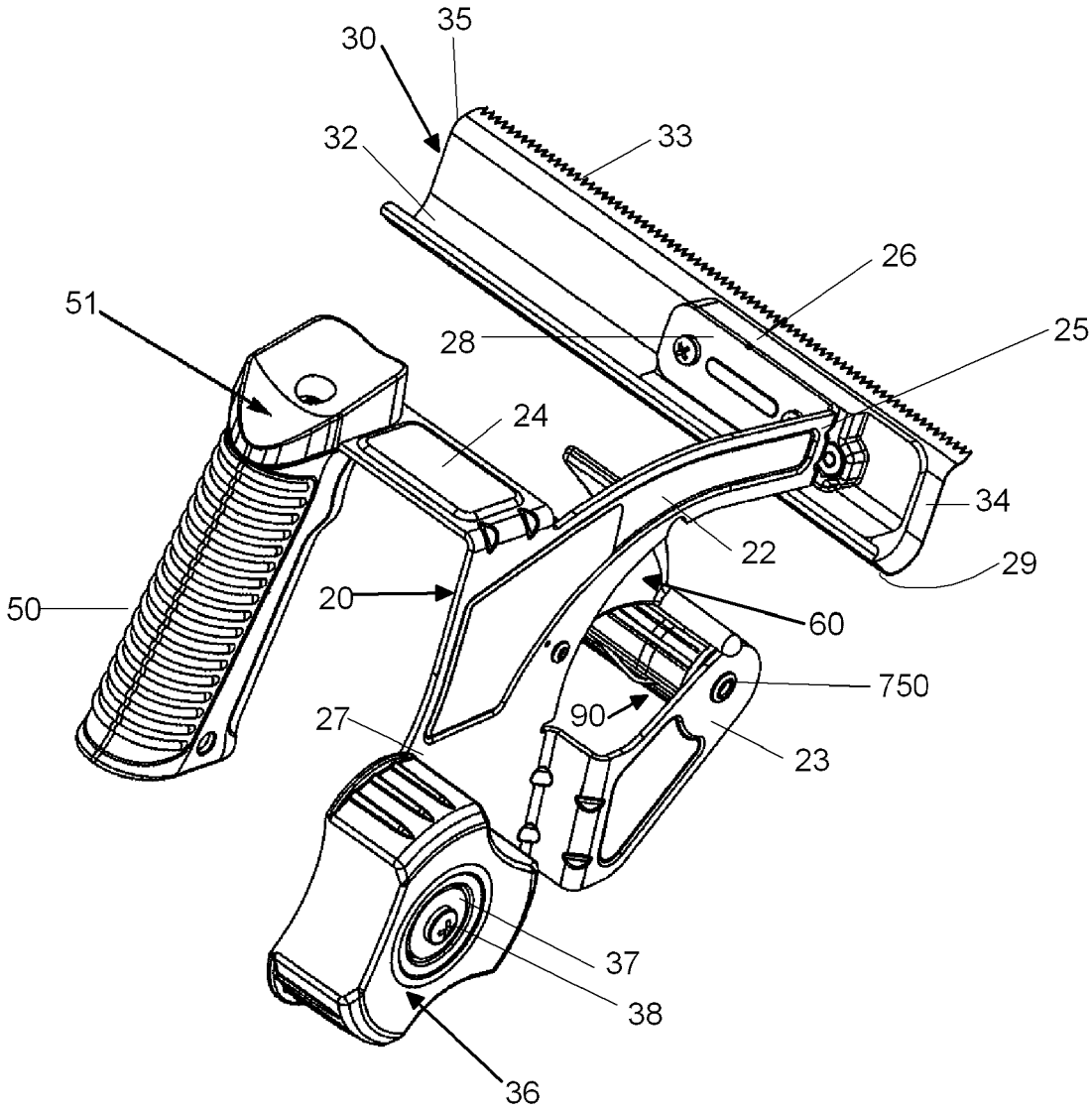
FIG. 1 is a perspective view of one preferred embodiment of a masking dispenser handle with thumbgrip.

Turning now to the drawings in which like reference characters indicate corresponding elements throughout the several views, attention is first directed to FIG. 1 which shows a hand held masking machine including a frame 20 having substantially a side section 22, offset section 23 and offset bracket 24. Offset section 23 and bracket 24 extend in opposite directions from side section 22. For purposes of orientation, it is considered that frame 20 includes a forward portion 25 and a rearward portion 27 and an inner side 510 and an outer side 520, as further seen in FIGS. 1 and 2. At the forward portion 25, frame 20 is provided with a mounting bracket 28 which is coupled to a nose plate 26 having outer arcuate surface 29. Frame 20, including each of the foregoing named elements, may be made of any material that would provide sufficient structural strength, but is preferably made from material such as plastic and/or metal, and is more preferably made from steel preferably having structural features (such as bends) to increase the structural integrity. Preferably, the mounting bracket 28 is of any material that would provide sufficient structural strength, but is preferably made from material such as plastic and metal, and/or is more preferably made from a plastic.

An elongate guide bar 30, stamped from relatively thin sheet metal, is detachably carried by nose plate 26 that is coupled to the mounting bracket 28. Guide bar 30 includes an arcuate portion 32 and serrated cutting edge 33. Orientated perpendicularly to side section 22, guide bar 30 further includes a fixed end 34 detachably secured to nose plate 26 that is coupled to the mounting bracket 28 and a free end 35. Arcuate surface 29 of nose plate 26 is matingly received within arcuate portion 32.

Tape roll holder 36 is rotatably mounted upon a spindle, not immediately illustrated, integral with rearward portion 27 of frame 20. Holder 36 is retained upon the spindle by means of a washer 37 and a screw 38 which is threaded into the spindle. Holder 36 rotates about a first axis substantially parallel to the screw 38 length (longitudinal axis of the screw), which is generally parallel to guide bar 30 and especially cutting edge 33. A roll of coiled, pressure-sensitive tape having a core with a bore may be detachably carried by tape roll holder 36.

A roll of coiled sheet (also called sheet material or masking material), for example paper or plastic, is held by a reel holder 90 rotatably carried by offset section 23. The reel 90 is rotatable about a second axis which is parallel to the first axis of the roll holder 36.

A handle 50 including a thumbgrip 51 for optimal control and comfort, having an axis generally parallel to side section 22 and generally perpendicular to axes of the tape roll holder 36 and reel 90, extends from offset bracket 24. During operation, a human hand holds handle 50 with the thumb on the thumbgrip 51 and moves the masking machine in a direction to dispense the tape and sheet. Accordingly, as sheet is dispensed and remains stationary, tape roll and sheet roll rotate. While the thumbgrip 51 may be made of any suitable material such as plastic, metal or wood, the presently preferred material is plastic. The sheet roll is offset relative to the tape roll such that tape overlaps one end of the sheet roll. Therefore, tape includes a first continuous component which is secured to the edge of the sheet and a second component which is available for continuous adhesion to the surface to be masked. Arcuate portion 32 of guide bar 30 functions as a shoe wiping along tape to ensure adhesion to the surface.

Figure 2:
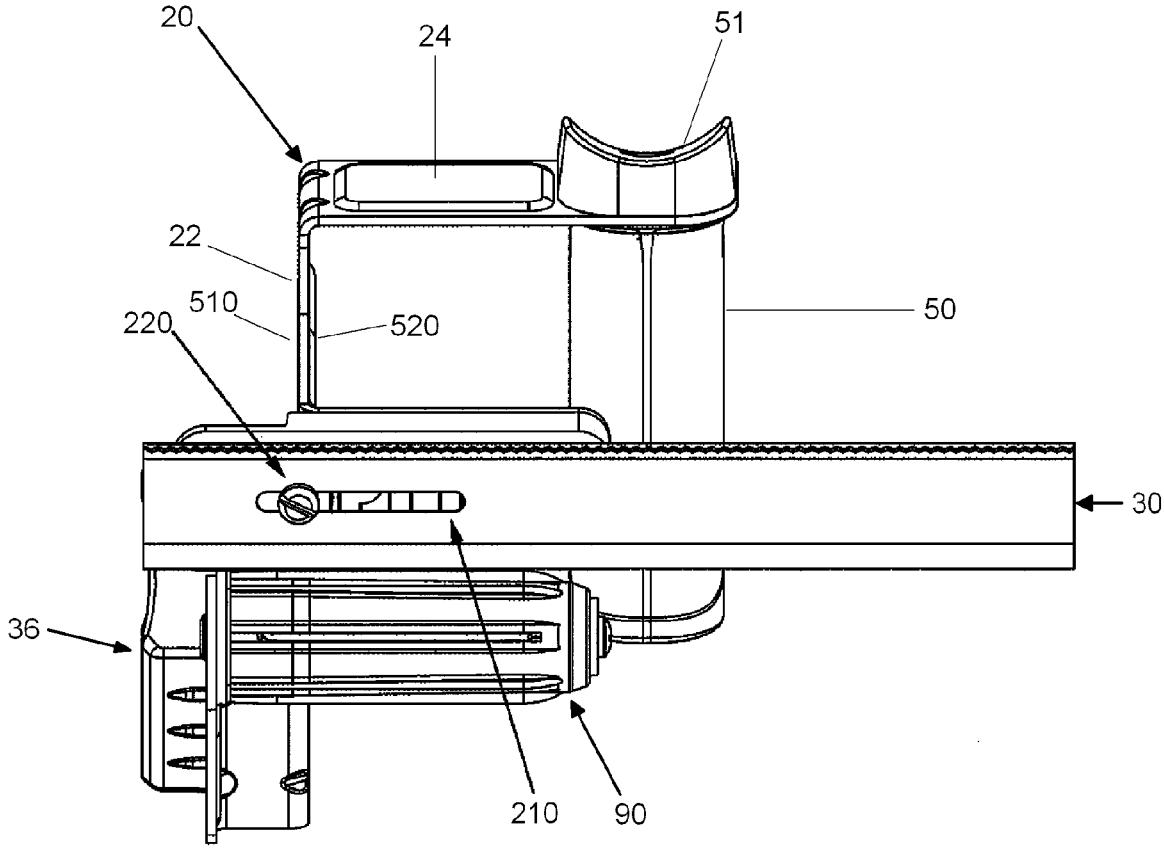
FIG. 2 is a horizontal view of one preferred embodiment of an adjustable blade slot and set screw.

In the preferred embodiment shown in FIG. 2, the guide bar 30 (some times called a cutting blade) includes a slotted adjusting means such as a blade slot 210 and a locking mechanism 220 to couple the guide bar 30 to the nose plate 26. Preferably, the locking mechanism 220 may be a set screw, thumb screw or screw lock that allows the blade to be adjusted in a continuous manner, and more preferably without tools.

Figure 3:
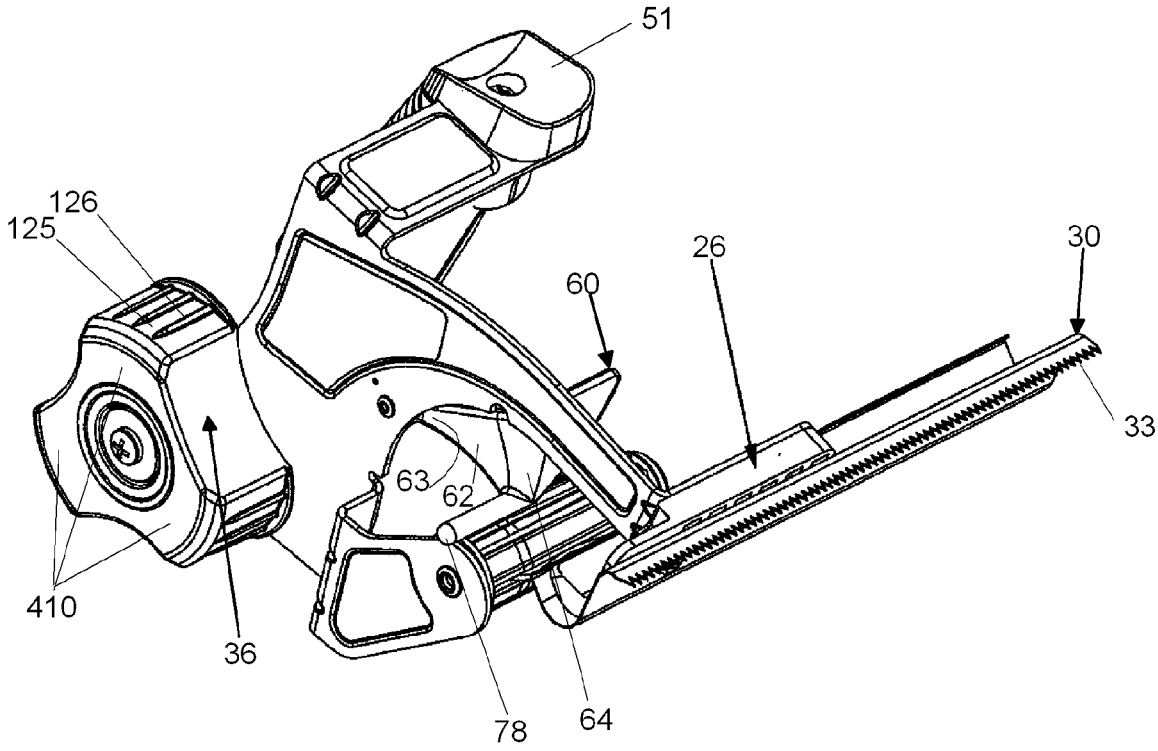
FIG. 3 is a perspective view of one preferred embodiment of a blade/nose assembly.

In the preferred embodiment shown in FIG. 3, that further shows a different view of the nose plate 26 that is coupled to the mounting bracket 28. Preferably, the nose plate 26 accommodates industry standard cutting blades. FIG. 3 also shows a tensioning means 60 for applying tension to the outer surface of the sheet roll and checking uncoiling of the sheet. It is seen that the improved sheet tensioning means 60 includes an arm 62 having tensioning fixed end 63, tensioning free end 64, secured projection 78 and a torsion spring 73 (or other biasing means) such that the fixed end 63 is movingly coupled to the frame 20 and the torsion spring 73 functions to urge the secured projection 78 toward the reel 90 to contact the tape to the edge of the sheet. Such tensioning means are well known and have been described U.S. Pat. No. 4,667,891 which has been incorporated by reference herein.

Figure 4:
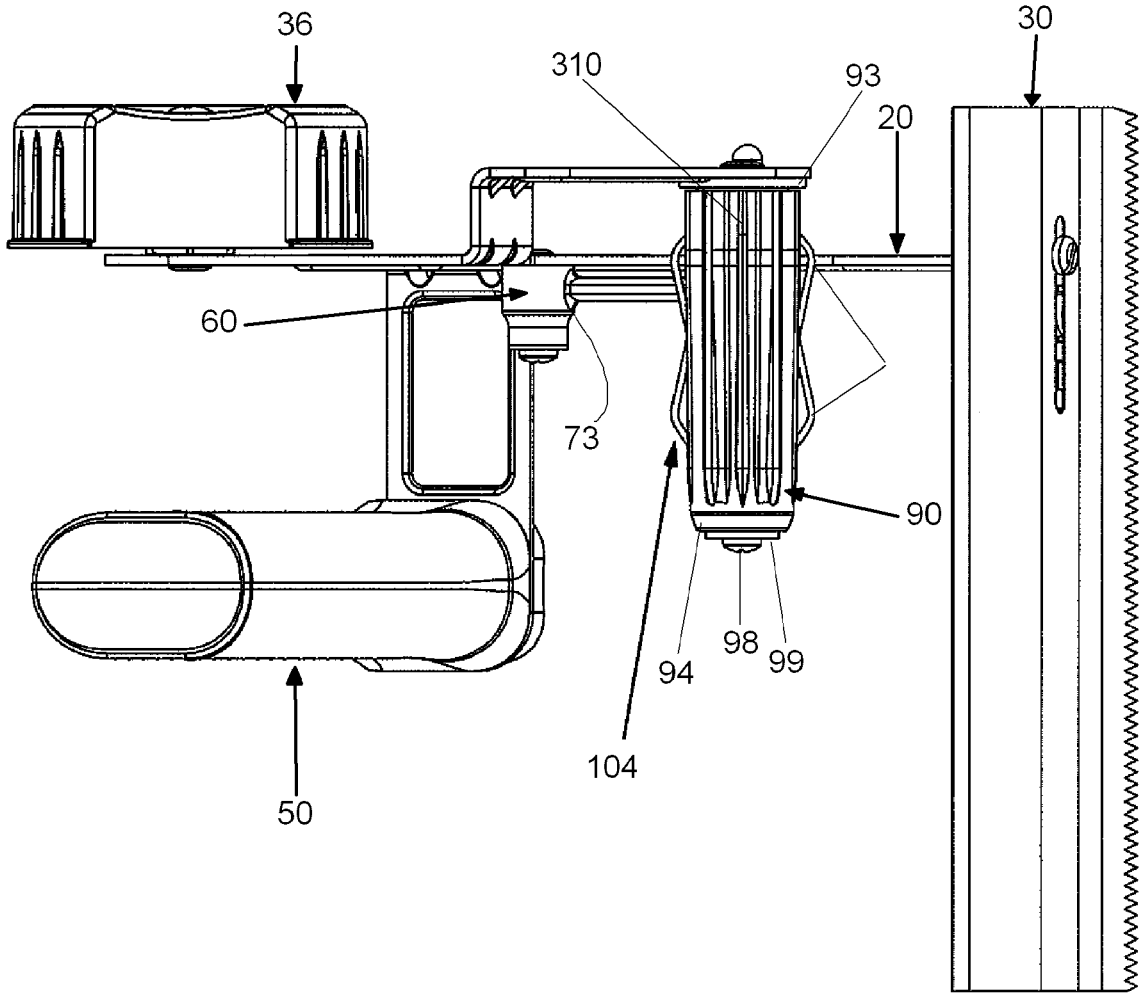
FIG. 4 is a bottom view of one preferred embodiment of a four point sheet reel spring(s).
Figure 5:
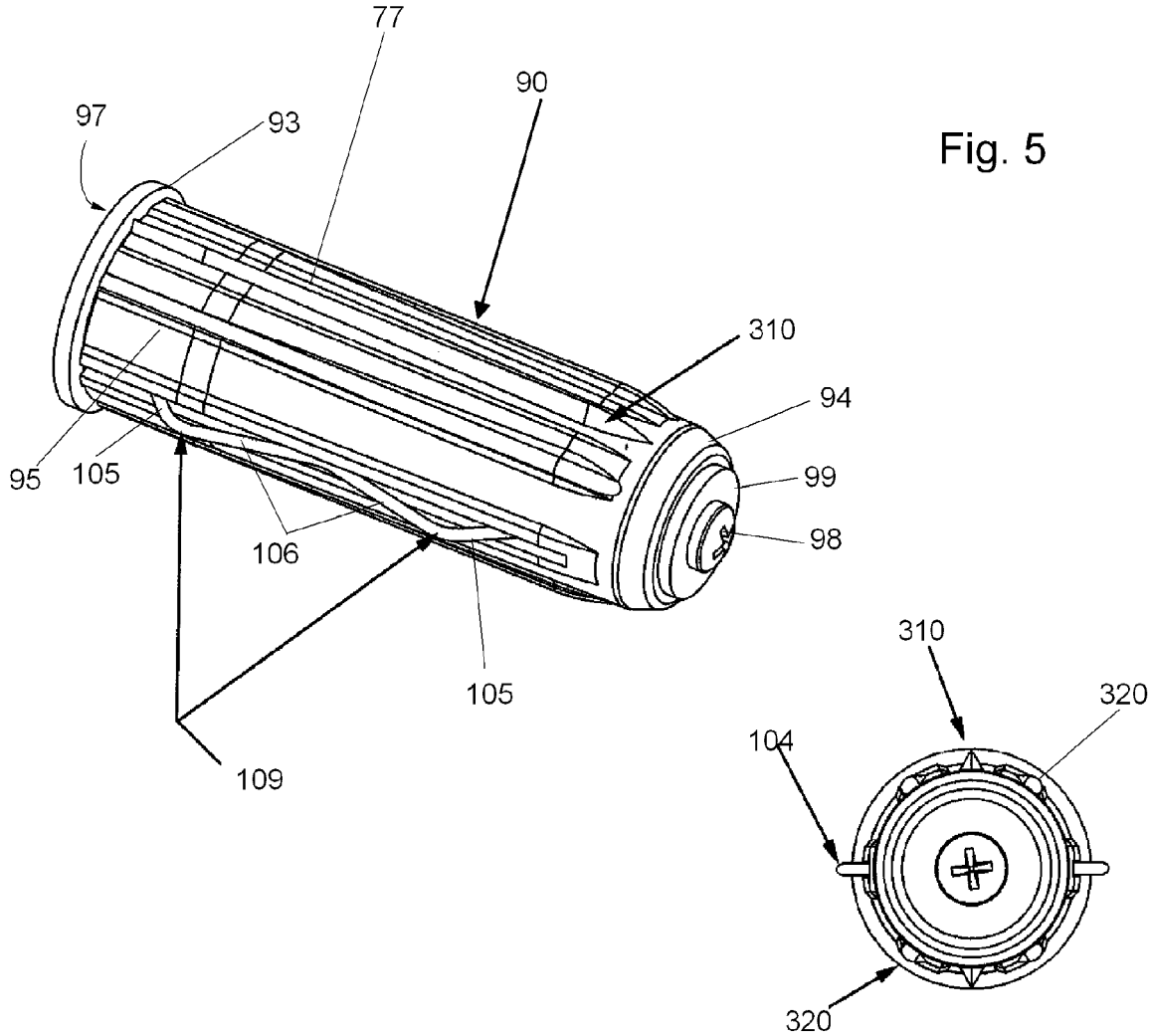
FIG. 5 is a detailed view of one preferred embodiment of a sheet reel with spring(s).
Figure 6:
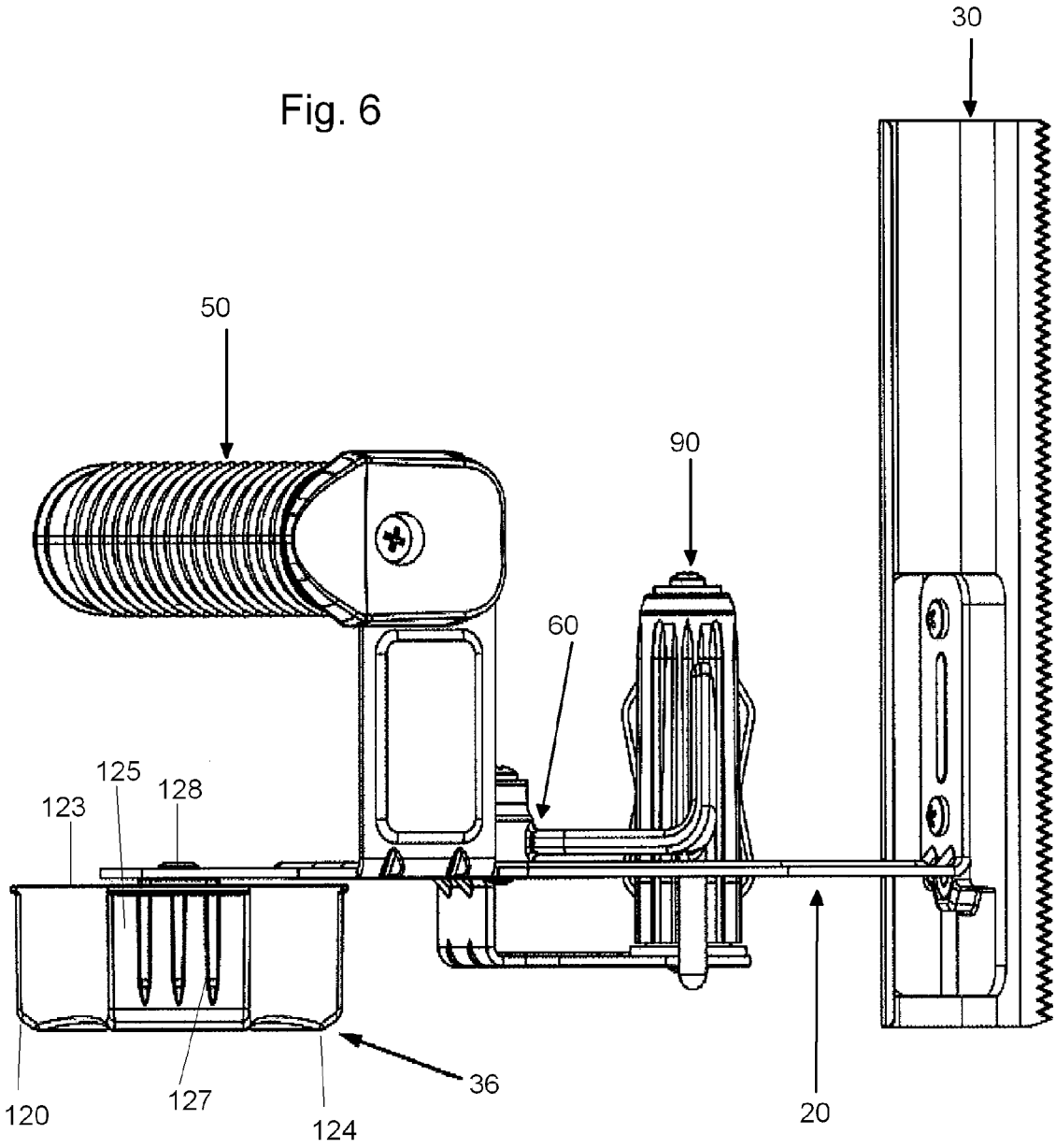
FIG. 6 is a bottom view of one preferred embodiment of a tape reel with tapered face.

Attention is now directed to the preferred embodiment shown in FIGS. 4 and 5, in which is seen a retention member 104 for stabilizing the inner core of the sheet (sometimes called a masking roll) material as it is being dispensed. In accordance with the masking machine described in connection with FIGS. 1 through 3, a spindle 750 extends from offset section 23 of frame 20 in a direction toward the free end 35 of guide bar 30. The reel 90 includes a holder 77, having inner end 93, outer end 94 and fluted outer surface 95 preferably comprising core stability ribs 310 (a preferred embodiment of the holder 77) and more preferably auxiliary ribs 320. It further includes a blind bore 97 which is rotatably journaled upon the spindle. Screw 98, passing through washer 99 and outer end 94, threadedly engages the free end of spindle 750 for attachment of holder 77 to frame 20. Conventional prior art practice teaches that the fluted outer surface 95 is slightly larger than the bore of the cardboard core of the sheet roll whereby the flutes partially embed within the core for retention of the sheet roll.

Retention member 104 (also known as a spring or contact spring), fabricated of a flexible material such as music wire, includes contact elements 105 and center elements 106. Each contact element 105 is bent to form two outwardly projecting contact portions 109. While not being held to this theory, it is believed that the retention member 104 form two outwardly projecting contact portions 109 (also called a double lobed spring) that increases the stability of the sheet (also known as masking material) roll on the reel.

The improved tape roll holding means of the instant invention, shown in FIGS. 1-4 and 6 includes a tape roll holder 36 having inner end 123, outer end 124 and a plurality of three radially extending circumferentially spaced hub portions 410 tapered on the outer surface 125 and each having each having longitudinally extending ribs 127. The outer surface 125 of the three radially extending circumferentially spaced hub portions 410 and the longitudinally extending ribs 127 define a peripheral surface that is adapted to the bore of the core of the tape roll. Spaced apart, outwardly projecting longitudinally extending ribs 127, that are also tapered from larger to smaller from the inner end 123 to the outer end 124, normally engage the bore of the core of the tape roll. Another bore extends axially through tape roll holder 36. Screw 38 passing through bore and carrying washer 37 is threaded into spindle 128 for attachment of holder 38 to frame 20 in accordance with conventional practice. Tape roll holder 36 may be made of any material of sufficient strength, such as metal, wood or plastic, but is preferably formed of plastic in accordance with conventional injection moulding techniques.

The preferred embodiment of the invention is described above in the Drawings and Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A hand held masking machine for dispensing sheet and tape to a surface comprising:

a frame having an outer side and an inner side, and a forward portion and a rearward portion;

an offset section to the frame displaced in the direction of the outer side of the frame;

a tape roll holder mounted on the outer side of the rearward portion of the frame for rotation about a first axis, the tape roll holder adapted to have a roll of tape mounted thereon;

a reel mounted on the inner side of the offset section of the frame for rotation about a second axis, the reel adapted to have a roll of sheet having a hollow cylindrical bore mounted thereon for rotation about the second axis;

an offset bracket mounted on the frame between the forward and rearward positions and extending in a direction substantially parallel to the second axis and away from the inner side of the frame;

a handle secured to the offset bracket and depending from the handle bracket so that the hand of the user of the masking machine is spaced from the inner side of the frame;

a mounting bracket mounted on the forward portion of the frame and extending inwardly from the frame in a direction substantially parallel to the second axis;

a nose plate coupled to the mounting bracket, the nose plate having a locking mechanism;

a guide bar including a blade slot having ends, the guide bar being adjustably coupled, in a continuous manner between the ends of the blade slot, to the nose plate using the locking mechanism.

2. The masking machine as recited in claim 1 wherein the reel further comprises two retention members coupled thereto, each retention member having two outwardly projecting contact portions.

3. The masking machine as recited in claim 2 wherein the reel further comprises at least two fluted outer surfaces.

4. The masking machine as recited in claim 3 wherein the tape roll holder has an inner end closer to the frame and an outer end and further comprises three radially extending circumferentially spaced hub portions having longitudinally extending ribs that define a peripheral surface that is tapered from the inner end to the outer end and adapted to the bore of the core of the tape roll.

5. The masking machine as recited in claim 2 wherein the tape roll holder has an inner end closer to the frame and an outer end and further comprises three radially extending circumferentially spaced hub portions having longitudinally extending ribs that define a peripheral surface that is tapered from the inner end to the outer end and adapted to the bore of the core of the tape roll.

6. The masking machine as recited in claim 1 wherein the tape roll holder has an inner end closer to the frame and an outer end and further comprises three radially extending circumferentially spaced hub portions having longitudinally extending ribs that define a peripheral surface that is tapered from the inner end to the outer end and adapted to the bore of the core of the tape roll.

7. The masking machine as recited in claim 1 wherein the locking mechanism is selected from the group consisting of set screw, thumb screw or screw lock.

8. The masking machine as recited in claim 1 wherein the tape roll holder has an inner end closer to the frame and an outer end and further comprises three radially extending circumferentially spaced hub portions having longitudinally extending ribs that define a peripheral surface that is tapered from the inner end to the outer end and adapted to the bore of the core of the tape roll.

9. The masking machine as recited in claim 1 further comprising a tensioning means coupled to the inner side of the frame wherein the tensioning means functions to contact the tape to the edge of the sheet.

10. The masking machine as recited in claim 9 wherein the tensioning means comprises an arm having a tensioning fixed end, a tensioning free end, a secured projection and a torsion spring wherein the torsioning fixed end is movably coupled to the inner portion of the frame such that the secured projection is urged toward the reel.

11. The masking machine as recited in claim 1 wherein the mounting bracket mounted on the forward portion of the frame only extends inwardly from the frame in a direction substantially parallel to the second axis, and the locking mechanism carried by the nose plate is positioned outwardly of the frame.

12. The masking machine as recited in claim 1 further including a thumbgrip having a bottom surface coupled to the handle and a top surface for receiving a thumb of a user, so as to interpose the thumbgrip between the users thumb and the handle.

* * * * *